US005266549A

United States Patent [19]

Bloodworth et al.

[11] Patent Number: 5,266,549

[45] Date of Patent: Nov. 30, 1993

[54] ACCEPTOR ELEMENT FOR THERMOSULBLIMATION PRINTING

[75] Inventors: Robert Bloodworth; Wolfgang Podszun, both of Cologne, Fed. Rep. of Germany; Hermann Uytterhoeven, Bonheiden, Belgium

[73] Assignee: AGFA-Gevaert Aktiengesellschaft

[21] Appl. No.: 775,043

[22] Filed: Oct. 11, 1991

[30] Foreign Application Priority Data

Oct. 25, 1990 [DE] Fed. Rep. of Germany ..... 4033906

[51] Int. Cl.[5] ..... B41M 5/035; B41M 5/38

[52] U.S. Cl. ..... 503/227; 428/195; 428/500; 428/913; 428/914

[58] Field of Search ..... 8/471; 428/195, 500, 428/913, 914; 503/227

[56] References Cited

U.S. PATENT DOCUMENTS 4,778,782 10/1988 Ito et al. ..... 503/227
4,908,345 3/1990 Egashira et al. ..... 503/227
5,085,932 2/1992 Fujita et al. ..... 428/331
5,096,876 3/1992 Jahn et al. ..... 503/227

FOREIGN PATENT DOCUMENTS 0262228 4/1988 European Pat. Off. ..... 503/227
0405248 1/1991 European Pat. Off. ..... 503/227

*Primary Examiner*—B. Hamilton Hess
*Attorney, Agent, or Firm*—Connolly & Hutz

[57] ABSTRACT

A dye acceptor material for thermosublimation printing comprising a support and a dye acceptor layer, characterized in that the dye acceptor layer contains a copolymer of a) 15 to 75% by weight of an aromatic vinyl compound,
b) 5 to 40% by weight (meth)acrylonitrile,
c) 10 to 70% by weight (meth)acrylates containing 4 to 18 C atoms in the alcohol radical,
d) 0 to 30% by weight other vinyl monomers, with the proviso that the glass transition temperature of the copolymer is above 40° C. and the ratio by weight of component a) to component b) is 1:1 to 4:1, is distinguished by high color density and adequate image stability for minimal lateral diffusion.

3 Claims, No Drawings

ACCEPTOR ELEMENT FOR THERMOSULBLIMATION PRINTING

This invention relates to a dye acceptor element for thermosublimation printing.

There are a number of methods for making printouts of video- or computer-stored images. Of these various methods, thermosublimation printing has proved to be superior by virtue of its advantages over other processes where specific requirements have to be satisfied. This recording method is based on the heat-induced transfer of a dye from a dye donor layer to a dye acceptor layer and is described, for example, in "High Quality Image Recording by Sublimation Transfer Recording Material", Electronic Photography Association Documents, 27 (2), 1988 and the literature cited therein. One particular advantage of this method is that it enables the intensity of color to be finely graduated.

Polymers of different classes of compounds may be used as the constituent material of the dye acceptor layer. Thus, EP-A 0 234 563 mentions the following examples of suitable materials for the acceptor layer:

1. Synthetic resins containing ester bonds, such as polyesters, polyacrylates, polyvinyl acetate, styrene/ acylate resins and vinyl toluene/acrylate resins
2. Polyurethanes
3. Polyamides
4. Urea resins
5. Synthetic resins containing other highly polar bonds, such as polycaprolactam, styrene resins, polyvinyl chloride, vinyl chloride/vinyl acetate copolymers and polyacylonitrile.

U.S. Pat. No. 4,705,522 mentions polycarbonate, polyurethane, polyester, polyvinyl chloride, poly(styrene-co-acrylonitrile), polycaprolactone and mixtures thereof for the dye acceptor layer.

EP-A 0 228 066 claims a dye acceptor layer having improved light stability which contains a mixture of polycaprolactone and a linear aliphatic polyester with poly(styrene-co-acrylonitrile) and/or bisphenol A polycarbonate.

U.S. Pat. No. 4,734,397 describes an image receptor element which contains a poly(styrene-co-acrylonitrile) layer. However, this layer is not used as a dye acceptor layer, but instead as a so-called compression layer.

The use of vinylidene chloride copolymers as an interlayer between a paper support and a dye acceptor layer is known from U.S. Pat. No. 4,748,150.

The dye acceptor layers available at the present time do not yet adequately satisfy the requirements of high color density, adequate image stability and good resolution. It is particularly important in this regard to achieve high color density and adequate image stability for minimal lateral diffusion.

The problem addressed by the present invention was to provide a dye acceptor element for thermosublimation printing which would not have any of the disadvantages mentioned above. This problem has been solved by the use of a special polymer in the dye acceptor element.

Accordingly, the present invention relates to a dye acceptor material for thermosublimation printing comprising a support and a dye acceptor layer, characterized in that the dye acceptor layer contains a copolymer of a) 15 to 75% by weight of an aromatic vinyl compound,
b) 5 to 40% by weight (meth)acrylonitrile, c) 10 to 70% by weight (meth)acrylates containing 4 to 18 C atoms in the alcohol radical,
d) 0 to 30% by weight other vinyl monomers, with the proviso that the glass transition temperature of the copolymer is above 40° C. and the ratio by weight of component a) to component b) is 1:1 to 4:1.

Aromatic vinyl compounds suitable for use in accordance with the invention are styrene, c-methyl styrene, p-methyl styrene, m-methyl styrene, p-tert. butyl styrene, p-chlorostyrene, p-chloromethyl styrene, vinyl naphthalene and vinyl naphthalene. Styrene is preferred.

The expression (meth)acrylonitrile is meant to encompass both methacrylonitrile and also acrylonitrile. The same applies to the expression (meth)acrylates.

The (meth)acrylates are derived from optionally substituted aliphatic, cycloaliphatic, aromatic or mixed aromatic-aliphatic $C_{4-18}$ alcohols. The aliphatic radicals may be both linear and branched and may be interrupted by oxygen.

Suitable (meth)acrylates are, for example, n-butyl acrylate, n-butyl methylacrylate, isobutyl acrylate, isobutyl methacrylate, n-hexyl acrylate, n-hexyl methacrylate, ethyl hexyl acrylate, ethyl hexyl methacrylate, n-octyl acrylate, n-octyl methacrylate, decyl acrylate, decyl methacrylate, stearyl acrylate, stearyl methacrylate, cyclohexyl acrylate, cyclohexyl methacrylate, 4-tert.-butyl cyclohexyl methacrylate, benzyl acrylate, benzyl methacrylate, phenyl ethyl acrylate, phenyl ethyl methacrylate, phenyl propyl acrylate, phenyl propyl methacrylate, phenyl octyl acrylate, phenyl nonyl acrylate, phenyl nonyl methacrylate, 3-methoxybutyl methacrylate, butoxyethyl acrylate, furfuryl methacrylate and tetrahydrofurfuryl acrylate.

Mixtures of different (meth)acrylates are also suitable. Mixtures partly containing ethyl hexyl acrylate, decyl methacrylate, dodecyl methacrylate or phenyl ethyl acrylate are preferred.

Suitable other monomers (component d) are vinylidene chloride, vinyl chloride, vinyl acetate, vinyl propionate, vinyl laurate and vinyl adipate.

The ratio by weight of component a to component b is important to the dyeability of the dye acceptor layer according to the invention. This ratio is from 1:1 to 4:1 and preferably from 2:1 to 4:1.

Another important characteristic of the dye acceptor layer is the glass transition temperature (Tg) of the copolymer. The Tg should be in the range from 40° to 100° C. and preferably in the range from 50° to 80° C. The Tg of the copolymer is a function of its composition and may be adjusted primarily through the type and quantity of component c).

If desired, other applicational properties may be controlled through component c). For example, the use of long-chain alkyl (meth)acrylates, such as decyl methacrylate or dodecyl methacrylate for example, leads to improved adhesiveness of the dye acceptor material according to the invention.

The molecular weight (Mg) of the copolymers is approximately 10,000 to 1,000,000 (weight average). The molecular non-uniformity is not critical. Typical values are in the range from 2 to 4.

Examples of preferred compositions of the copolymer in % by weight are shown in Table 1. These examples are not intended to limit the invention in any way. In Table 1, S=styrene, AN=acrylonitrile, MAN=methacrylonitrile and VDC=vinylidene chloride.

TABLE 1

| a) | b) | c) | d) |
|---|---|---|---|
| 40% S | 20% AN | 20% decyl methacrylate | — |
| | | 20% phenyl ethyl methacrylate | — |
| 45% S | 20% AN | 25% decyl methacrylate | — |
| | | 10% phenyl ethyl methacrylate | |
| 45% S | 20% AN | 20% ethyl hexyl acrylate | — |
| | | 15% ethyl phenyl acrylate | |
| 40% S | 20% AN | 30% decyl methacrylate | — |
| | | 10% furfuryl acrylate | |
| 50% S | 25% AN | 25% ethyl hexyl acrylate | — |
| 47% S | 23% AN | 30% ethyl hexyl acrylate | — |
| 50% S | 25% AN | 25% decyl methacrylate | — |
| 54% S | 17% AN | 29% decyl methacrylate | — |
| 45% S | 20% MAN | 35% decyl methacrylate | — |
| 40% S | 20% AN | 25% decyl methacrylate | 15% VDC |
| 45% S | 20% AN | 15% ethyl hexyl acrylate | 20% VDC |
| 42% S | 16% AN | 20% decyl methacrylate | 12% VDC |
| | | 10% furfuryl acrylate | |

The copolymers may be prepared by polymerization processes known per se, including for example bulk polymerization, solution polymerization, suspension polymerization and emulsion polymerization, These processes are described in detail, for example, in Houben-Weyl, Methoden der Organischen Chemie, Vol. E20 / Part 1. An emulsion polymerization process using sodium alkyl sulfonate as emulsifier and potassium peroxydisulfate as initiator is particularly suitable.

Suitable support materials for the acceptor layer according to the invention are both papers, particularly synthetic and polymer-coated papers, and films based on polyester, polyamide or polycarbonate. In addition to the acceptor layer according to the invention and the support material, the receptor element may of course contain other layers known for this purpose. Thus, it can be favorable to apply an anti-adhesion layer, for example of polysiloxane, above the acceptor layer. To improve the adhesion of the acceptor layer to the support material, an interlayer, for example of gelatine, may be applied.

The copolymers may be processed from solution or, preferably, aqueous dispersion. Suitable solvents are, for example, acetone, methyl ethyl ketone, tetrahydrofuran, dioxane, ethyl acetate, dichloromethane and dimethyl formamide. The solution or dispersion may be applied to the support by casting or knife coating.

The dye acceptor element may be combined with the dye donor elements typically used in thermosublimation printing.

The dye images obtained are distinguished by high resolution, high brilliance and good long-term stability.

EXAMPLES 1 TO 20

Synthesis of Copolymers 3.0 g emulsifier (long-chain alkyl sulfonate) dissolved in 300 g deionized water are introduced into a 1 liter stirred reactor. The emulsifier solution is then heated with stirring (200 r.p.m.) under nitrogen to a temperature of 70° C., after which 25 g of the monomer mixture shown below are added. The polymerization reaction is initiated by addition of a solution of 0.5 g potassium peroxydisulfate in 20 g deionized water. After initiation of the reaction, another 250 g of the monomer mixture, to which 0.05 g dodecyl mercaptan has been added, and—in a separate inflow—a solution of 0.75 g potassium peroxydisulfate and 4.0 g Mersolat MK 30 in 200 g water are added over a period of 6 hours. 0.75 g potassium peroxydisulfate dissolved in 15 g deionized water are then added and the temperature is kept at 75° C. for 8 hours. The following Table shows the composition of the monomer mixture in % by weight. In the Table, DMA=decyl methacrylate, EHA=ethyl hexyl acrylate, FA=furfuryl acrylate and PEMA=phenyl ethyl methacrylate. The other abbreviations used are explained in Table 1.

| Ex. No. | AN | MAN | S | DMA | EHA | FA | PEMA | VDC |
|---|---|---|---|---|---|---|---|---|
| 1 | 20 | — | 45 | 35 | — | — | — | — |
| 2 | 23 | — | 47 | 30 | — | — | — | — |
| 3 | 35 | — | 35 | 30 | — | — | — | — |
| 4 | 17 | — | 54 | 29 | — | — | — | — |
| 5 | 25 | — | 50 | 25 | — | — | — | — |
| 6 | 23 | — | 47 | — | 30 | — | — | — |
| 7 | 17 | — | 54 | — | 29 | — | — | — |
| 8 | 25 | — | 50 | — | 25 | — | — | — |
| 9 | — | 20 | 45 | 35 | — | — | — | — |
| 10 | 20 | — | 40 | 30 | — | 10 | — | — |
| 11 | 20 | — | 40 | 25 | — | — | 15 | — |
| 12 | 20 | — | 45 | 25 | — | — | 10 | — |
| 13 | 20 | — | 40 | 20 | — | — | 20 | — |
| 14 | 18 | — | 37 | 25 | — | — | 20 | — |
| 15 | 20 | — | 40 | — | 25 | — | — | 15 |
| 16 | 20 | — | 40 | 25 | — | — | — | 15 |
| 17 | 20 | — | 45 | 20 | — | — | — | 15 |
| 18 | 20 | — | 40 | — | 20 | — | — | 20 |
| 19 | 20 | — | 40 | 20 | — | — | — | 20 |
| 20 | 20 | — | 45 | — | 15 | — | — | 20 |

EXAMPLES 21 TO 44

Production and Testing of Acceptor Elements

The copolymer dispersions obtained in Examples 1 to 20 were divided into two parts. One part was adjusted with deionized water to a solids content of 10% by weight and directly used for the production of image receptor layers. The copolymer was precipitated from the other part by addition of a saturated magnesium sulfate solution. The precipitated copolymer was washed thoroughly with water, dried and dissolved in methyl ethyl ketone (10% by weight solids).

The 10% by weight copolymer dispersions or copolymer solutions were knife-coated in a wet film thickness of 50 μm onto a paper which was coated on both sides with polyethylene and to one side of which a gelatine layer had been additionally applied over the polyethylene. The copolymer layer was applied to this side. The coatings were dried at room temperature and then heated for 15 minutes to 90° C. The dry layer thicknesses were approximately 4.5 μm.

Test images were produced on the receptor elements obtained using a Mitsubishi CP-100 E video printer and Mitsubishi CK 100S dye cassette. The color intensities were determined by microdensitometry. The figures indicated are the black-and-white densities measured on a black surface of the test image without a filter.

Image sharpness was optically evaluated immediately after printing, after storage for 3 days at room temperature and after storage for 3 days at 57° C./35% relative air humidity.

| Ex. No. | Copolymer of Ex. No. | Processing from | Density | Sharpness after printing | Sharpness after 3d/57° C. |
|---|---|---|---|---|---|
| 21 | 1 | Water | 1.96 | ++ | ++ |
| 22 | 1 | MEK | 1.93 | ++ | ++ |
| 23 | 2 | Water | 1.99 | ++ | ++ |
| 24 | 2 | MEK | 1.73 | ++ | ++ |
| 25 | 3 | Water | 1.77 | ++ | ++ |

-continued

| Ex. No. | Copolymer of Ex. No. | Processing from | Density | Sharpness after printing | Sharpness after 3d/57° C. |
|---|---|---|---|---|---|
| 26 | 4 | Water | 1.74 | ++ | ++ |
| 27 | 5 | Water | 1.82 | ++ | ++ |
| 28 | 6 | Water | 2.04 | ++ | ++ |
| 29 | 6 | MEK | 2.03 | ++ | ++ |
| 30 | 7 | Water | 2.04 | ++ | ++ |
| 31 | 7 | MEK | 2.07 | ++ | ++ |
| 32 | 8 | Water | 1.90 | ++ | ++ |
| 33 | 9 | Water | 1.76 | ++ | ++ |
| 34 | 10 | Water | 1.98 | ++ | ++ |
| 35 | 11 | Water | 2.09 | ++ | ++ |
| 36 | 12 | Water | 2.01 | ++ | ++ |
| 37 | 13 | Water | 2.03 | ++ | ++ |
| 38 | 14 | Water | 1.97 | ++ | ++ |
| 39 | 15 | Water | 1.92 | ++ | ++ |
| 40 | 16 | Water | 1.94 | ++ | ++ |
| 41 | 17 | Water | 1.89 | ++ | ++ |
| 42 | 18 | Water | 1.88 | ++ | ++ |
| 43 | 19 | Water | 1.92 | ++ | ++ |
| 44 | 20 | Water | 1.87 | ++ | ++ |

MEK: methyl ethyl ketone
++: very good

We claim:

1. A dye acceptor material for thermosublimation printing comprising a support and a dye acceptor layer, characterized in that the dye acceptor layer contains a copolymer of a) 15 to 75% by weight of an aromatic vinyl compound, b) 5 to 40% by weight (meth)acrylonitrile, c) 10 to 70% by weight (meth)acrylates containing 4 to 18 C atoms in the alcohol radical, d) 0 to 30% by weight other vinyl monomers, selected from the group consisting of vinylidene chloride, vinyl chloride, vinyl acetate, vinyl propionate, vinyl laurate and vinyl adipate, with the proviso that the glass transition temperature of the copolymer is above 40° C. and the ratio by weight of component a) to component b) is 1:1 to 4:1.

2. A dye acceptor material as claimed in claim 1, characterized in that the aromatic vinyl compound is styrene.

3. A dye acceptor material as claimed in claim 2, characterized in that the copolymer contains 5 to 25% by weight vinylidene chloride as the other vinyl monomer d).

* * * * *